US007520633B2

(12) United States Patent
Hornsby et al.

(10) Patent No.: US 7,520,633 B2
(45) Date of Patent: Apr. 21, 2009

(54) LIGHTING AND DISPLAY APPARATUS

(75) Inventors: James Russell Hornsby, St. Louis, MO (US); Marcellus Rambo Benson, Chesterfield, MO (US); James Augustus Keefe, III, O'Fallon, MO (US); Joseph Lee McGowan, St. Charles, MO (US); Ashley B. Hornsby, Clayton, MO (US)

(73) Assignee: Cepia, LLC, St. Louis, MO (US)

( * ) Notice: Subject to any disclaimer, the term of this patent is extended or adjusted under 35 U.S.C. 154(b) by 15 days.

(21) Appl. No.: 11/327,159

(22) Filed: Jan. 6, 2006

(65) Prior Publication Data

US 2006/0221599 A1 Oct. 5, 2006

Related U.S. Application Data

(60) Provisional application No. 60/667,858, filed on Apr. 1, 2005.

(51) Int. Cl.
*F21V 9/00* (2006.01)
*A63H 33/22* (2006.01)
*A63H 33/26* (2006.01)

(52) U.S. Cl. ..... 362/231; 362/249; 362/806; 446/219; 446/485

(58) Field of Classification Search ..... 362/103, 362/231, 240, 253, 234, 249, 251, 252, 294, 362/394, 806, 357; 5/636, 639, 905; 446/175, 446/219, 484, 485
See application file for complete search history.

(56) References Cited

U.S. PATENT DOCUMENTS 3,568,144 A 3/1971 Streb
4,359,601 A 11/1982 England
4,480,294 A * 10/1984 Carboni ..... 362/184
4,768,086 A 8/1988 Paist
4,972,533 A * 11/1990 Brown ..... 5/413 R
5,316,293 A * 5/1994 Hamilton ..... 473/570
5,400,230 A * 3/1995 Nicoletti ..... 362/253

(Continued)

FOREIGN PATENT DOCUMENTS

DE 199 41 589 A1 8/2000

(Continued)

OTHER PUBLICATIONS

Vittal Rao, "Two LEDs Blend and Blink to Indicate Six States", Electronic Design, vol. 30, No. 16, Aug. 5, 1982, p. 220.

(Continued)

*Primary Examiner*—John A Ward
(74) *Attorney, Agent, or Firm*—Nathan J. Witzany; Dorsey & Whitney LLP

(57) ABSTRACT

A lighting system, apparatus and method that can be integrated into an office or household item. The lighting system has one or more light modules, each comprising three lights of a different color. The light modules further have a cover component having a hole positioned above the lights. The lighting system may further have a cushioned layer coupled to the light modules. The light modules are coupled to a power source and an integrated circuit, wherein the integrated circuit is configured to operate the light modules.

8 Claims, 17 Drawing Sheets

U.S. PATENT DOCUMENTS

| | | | | |
|---|---|---|---|---|
| 5,947,789 | A | 9/1999 | Chan | |
| 5,961,201 | A * | 10/1999 | Gismondi | 362/233 |
| 6,095,661 | A | 8/2000 | Lebens et al. | |
| 6,241,362 | B1 | 6/2001 | Morrison | |
| 6,311,350 | B1 | 11/2001 | Kaiserman et al. | |
| 6,746,131 | B1 | 6/2004 | Goldstein et al. | |
| 6,888,322 | B2 | 5/2005 | Dowling et al. | |
| 7,258,463 | B2 * | 8/2007 | Sloan et al. | 362/231 |
| 2002/0017879 | A1 | 2/2002 | Denny et al. | |
| 2004/0067713 | A1 | 4/2004 | Fong | |
| 2004/0067714 | A1 | 4/2004 | Fong | |

FOREIGN PATENT DOCUMENTS

| | | | |
|---|---|---|---|
| EP | 0328358 | A2 | 8/1989 |
| EP | 0494310 | A1 | 7/1992 |
| EP | 0 959 297 | A | 11/1999 |
| EP | 1 435 483 | A | 7/2004 |
| GB | 2288903 | A | 1/1995 |
| GB | 2349942 | A | 11/2000 |
| JP | 6215750 | A | 1/1987 |
| JP | 756523 | A | 3/1995 |
| JP | 831213 | A | 2/1996 |
| JP | 10123591 | A | 5/1998 |
| JP | 200322012 | A | 11/2000 |

OTHER PUBLICATIONS

"Sound-to-light Unit Effects on a Budget", by K Wairaven, *Elektor Electronics*, Tunbridge Wells, GB, vol. 22, No. 246, Jul. 1, 1996, pp. 78-81, 83.

* cited by examiner

Desk Lamp

Large Desk Cube

Small Desk Cube

RGB Light Box

RGB Tower

Remarks: 1. For 16" Square pillow, the Module is located around 1/3" height of the polyester at front side.
2. For 15"*6" Tube pillow, the Module is located around 1/3" height of the polyester at front side.
3. The 5 sets LED are evenly distributed on the sponge.
4. All the welding points will be fixed with hot melt glue.

Example of simple ramp pattern

LIGHTING AND DISPLAY APPARATUS

CROSS-REFERENCE TO RELATED APPLICATION(S)

This application claims priority to U.S. provisional patent application Ser. No. 60/667,858, filed Apr. 1, 2005, which is incorporated herein by reference in its entirety.

FIELD OF THE INVENTION

The present invention relates to lighting and display apparatus, systems and methods and, more particularly such systems and methods that can be implemented into an office or household product or item such as, for example, a pillow or furniture.

BRIEF SUMMARY OF THE INVENTION

In one embodiment, the lighting apparatus comprises one or more light modules integrated into or associated with the product, with each light module having individual luminaries, lights or light sources of different colors.

In one preferred embodiment, the light or light sources are red, green and blue. One reason for this is that these colors constitute a known technology that forms a full electrical light color spectrum, i.e., in electrical light format, it is possible to produce virtually all colors from these three basic colors. This technology may be referred to as "rgb" technology.

Each of the lights in a module can be controlled or activated or de-activated independently, and each module can be controlled or activated and de-activated independently. The lighting apparatus also comprises a power source, a central processing unit ("CPU"), integrated circuit ("IC") or other suitable controller that controls the lights, and at least one activation switch for activating or de-activating the lighting apparatus. The system, method, and apparatus of the present invention provides for a lighting system that can create variable, sequenceable and/or patterned colored lighting that originates within some portion of the product or item into which the lighting apparatus is integrated. Such a system, according to one embodiment, can provide aesthetically pleasing patterns of light such as flashing lights, repeating lights of different colors, smoothly transitioning colored light changes, animation of color or imagery, or any other types of lighting displays possible with colored lights.

While multiple exemplary embodiments, including preferred embodiments, are disclosed and described herein, and depicted in accompanying FIGS. 1-17, still other embodiments of the present invention will become apparent to those skilled in the art. As will be realized, the invention is capable of modifications in various aspects, all without departing from its spirit and scope. Accordingly, the drawings and this description are to be regarded as illustrative in nature and not restrictive.

DETAILED DESCRIPTION

The present invention comprises novel and advantageous lighting and display apparatus, systems and methods. As discussed in one embodiment herein, the lighting system of the present invention is integrated into a pillow. However, according to alternative embodiments and without limitation, the lighting system can be integrated or implemented into bedding, plush figures, such as a teddy bear, rugs, articles of clothing, furniture, inflatable items (including for example inflatable furniture, toys, figures, sports equipment, tents, outdoor play sets), lamps, lanterns, dispensing devices, clocks, wall décor, desk accessories, CD racks, home décor, other home products, other office products, or any products for which a lighting system in accordance with the present invention would be useful or desirable. Examples of some of these and other aspects or embodiments of the present invention are depicted in FIGS. 3-7, and in FIGS. 12-15, which show some of the colors, color combinations, illumination, progressions, intensities, and/or patterns that can be displayed, created or produced in accordance with the present invention.

With regard to fastening, mounting, attaching or connecting the components of devices of the present invention, unless specifically described as otherwise, conventional fasteners such as screws, rivets, toggles, pins and the like may be used. Other fastening or attachment means appropriate for connecting components include friction fitting, adhesives, welding and soldering, the latter particularly with regard to electrical or processing components or systems of the devices. Any suitable electronic, electrical, communication, computer or processing components may be used, including any suitable electrical components and circuitry, light sources, wires, wireless components, sensors, chips, boards, micro-processing or control system components, software, firmware, hardware, etc.

Figure 1:
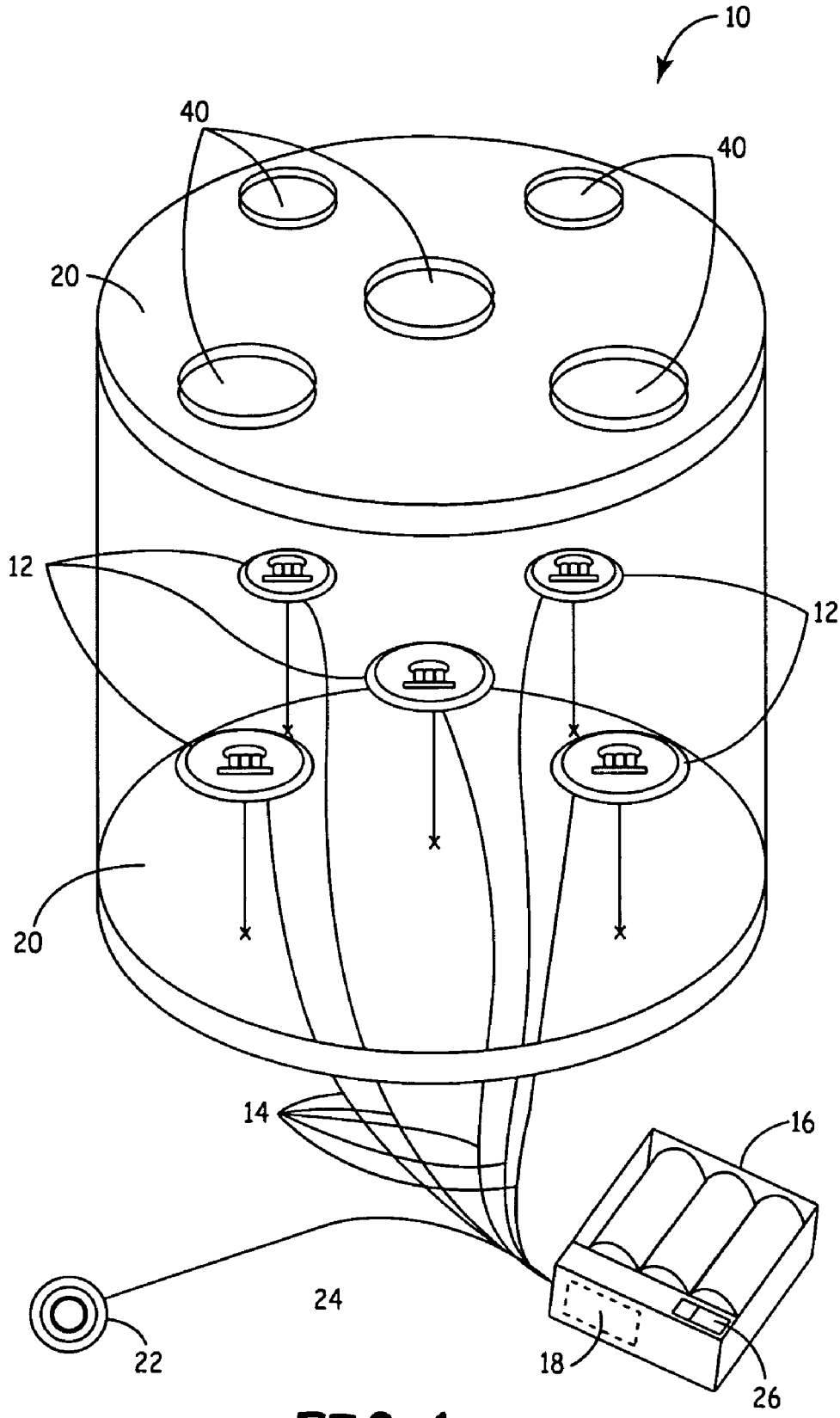
FIG. 1 is a schematic drawing of the lighting system of the present invention.
Figure 8:
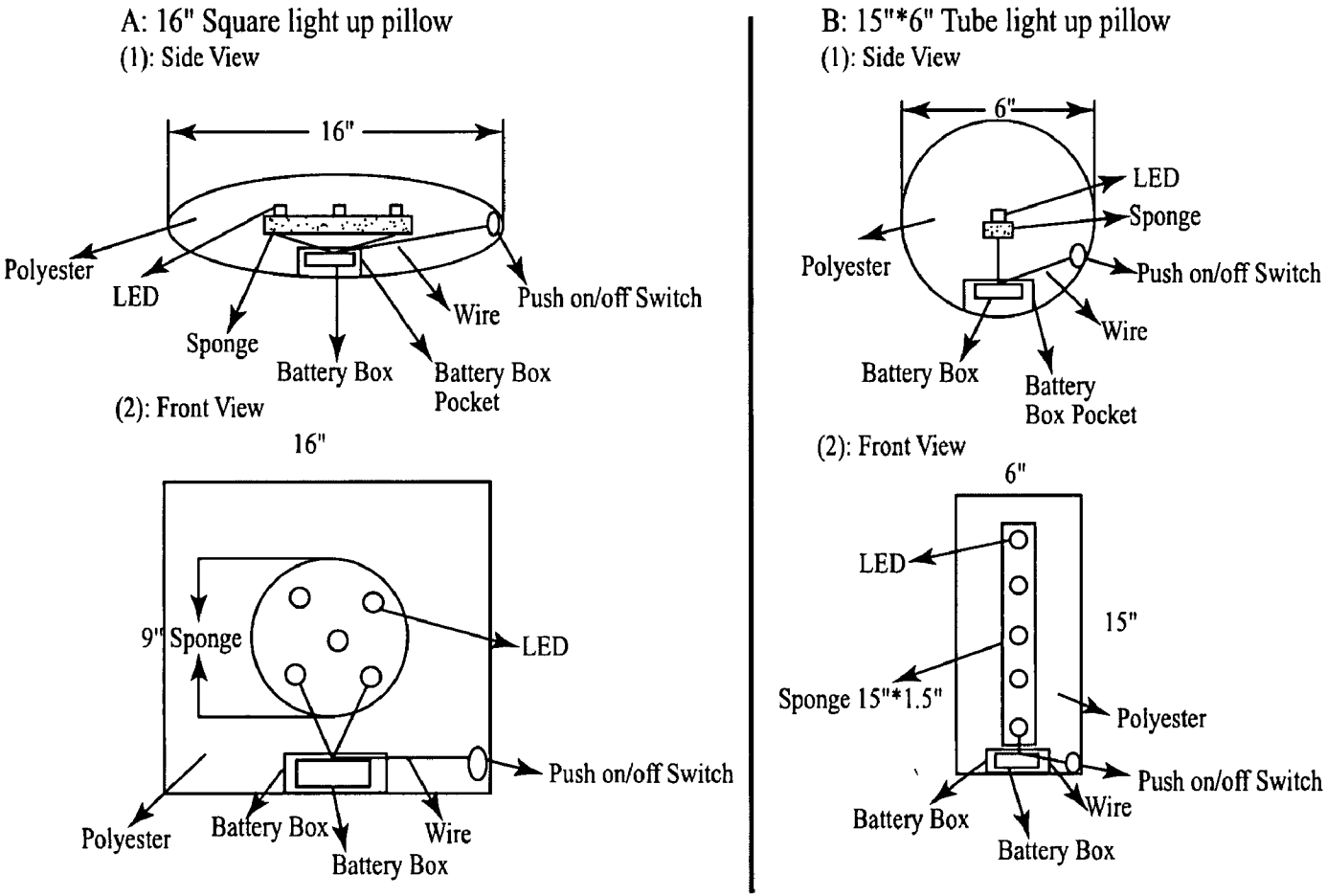
FIG. 8 is schematic views of embodiments of the lighting system of the present invention as used in pillows.

FIG. 1 depicts a schematic drawing of a lighting system 10 in a pillow according to one embodiment of present invention. The system includes light modules 12 connected by wires 14 to a power source 16 and a CPU 18. The modules 12 are disposed between two layers of cushioned material 20. As depicted in FIG. 1, the CPU 18 is an integrated circuit that is integrated into the power source 16. Alternatively, the CPU is a separate component. An activation switch 22 that can activate and de-activate (or turn "on" and "off") the system 10 is connected by a wire 24 to the power source 16. Further, a slide activation or other suitable switch 26 that can activate, de-activate, or test the system 10 is integrated into the power source 16. Alternatively, the slide activation switch 26 is a separate component. FIG. 8 depicts additional exemplary embodiments of the present invention as used in pillows.

Figure 2A:
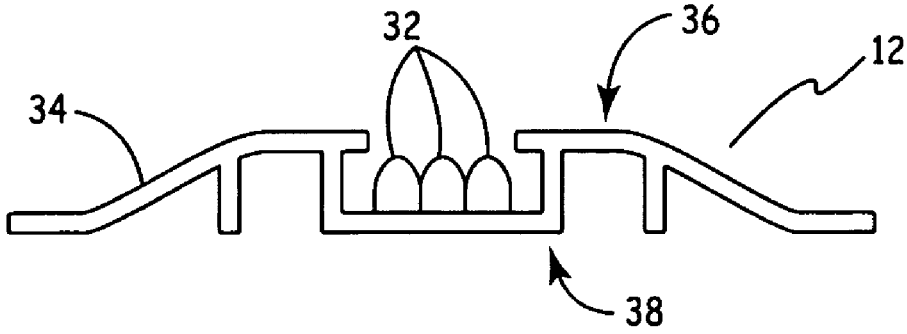
FIG. 2A is a cutaway profile view of a light module of the present invention.
Figure 2B:
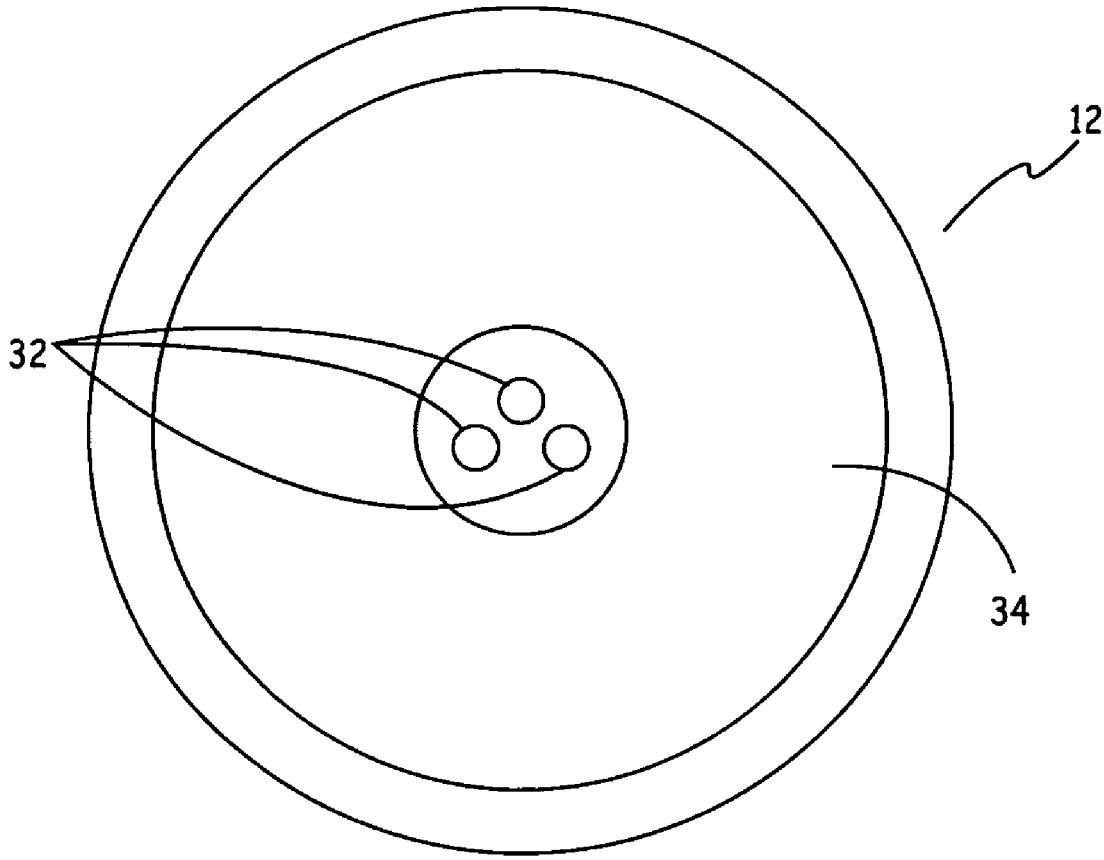
FIG. 2B is a top view of a light module of the present invention.
Figure 3:
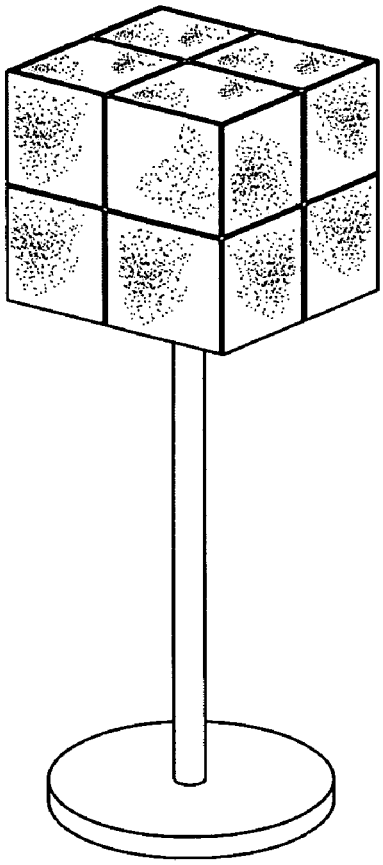
FIG. 3 is a perspective view of one embodiment of the lighting system of the present invention as used in desk lamps.
Figure 3:
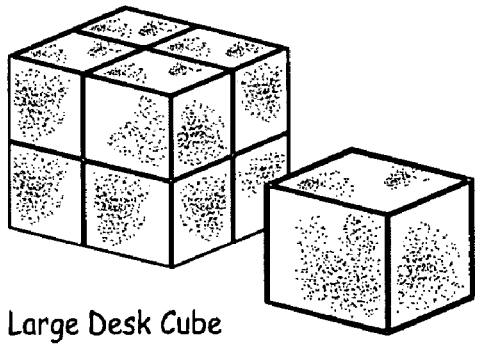
Figure 4:
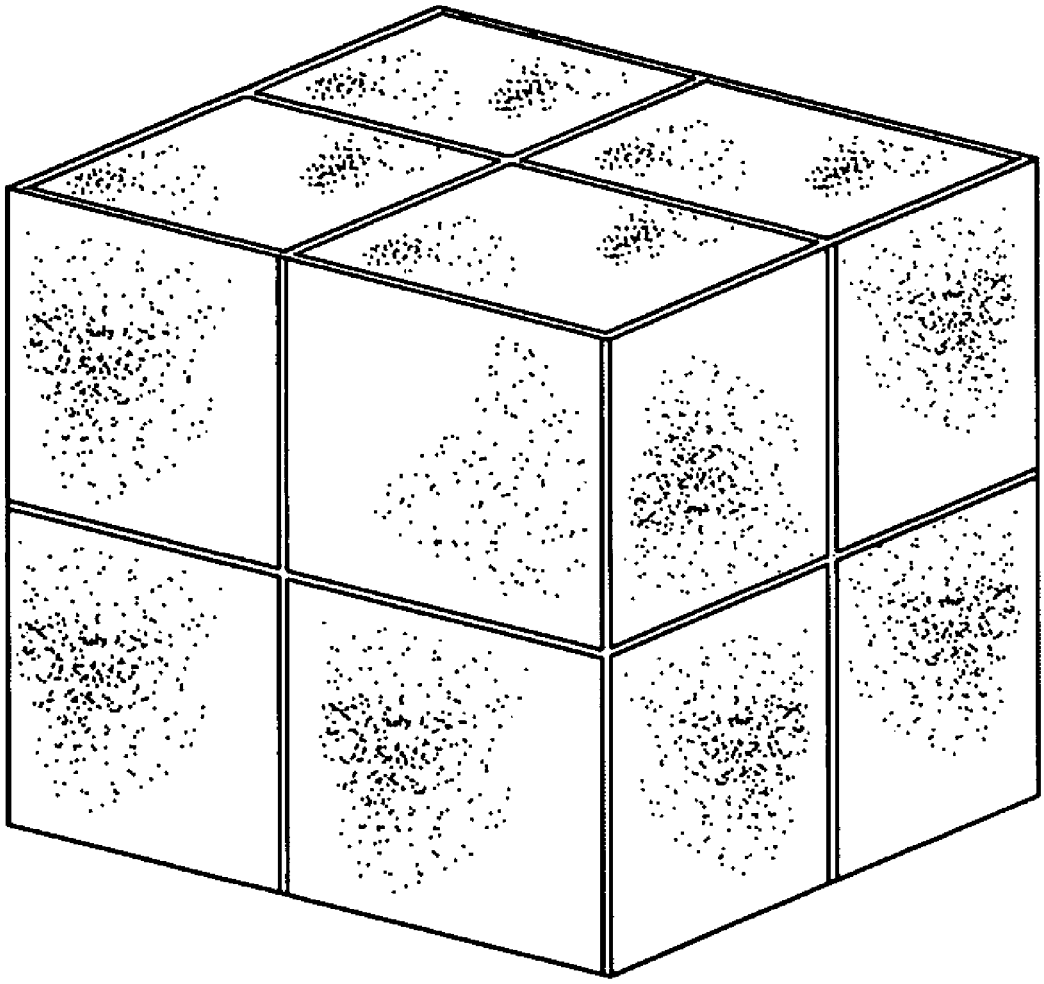
FIG. 4 is a perspective view of one embodiment of the lighting system of the present invention as used in a light cube.
Figure 5:
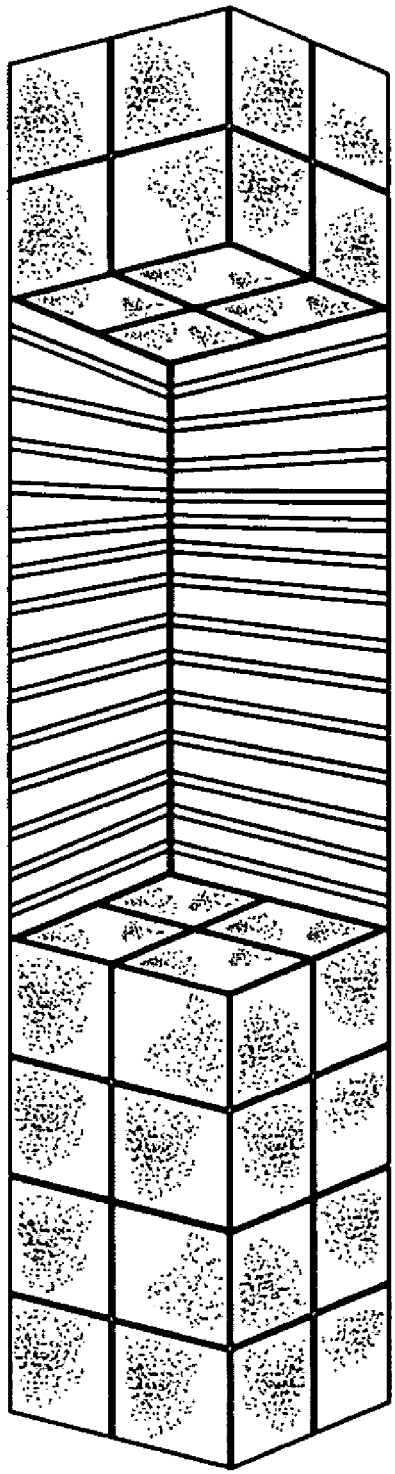
FIG. 5 is a perspective view of one embodiment of the lighting system of the present invention as used in a CD tower.
Figure 6:
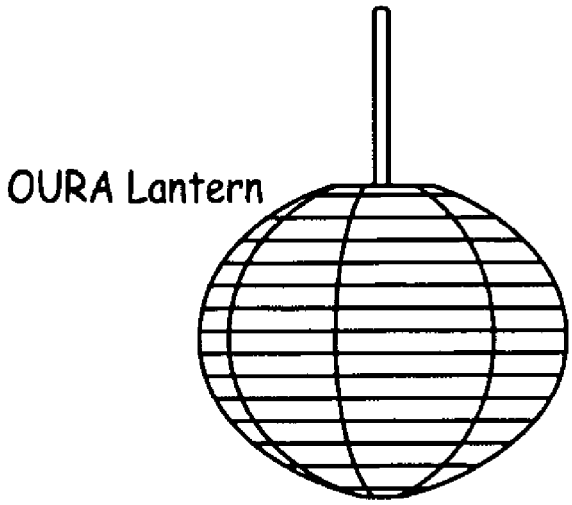
FIG. 6 is a perspective view of one embodiment of the lighting system of the present invention as used in a lantern.
Figure 7:
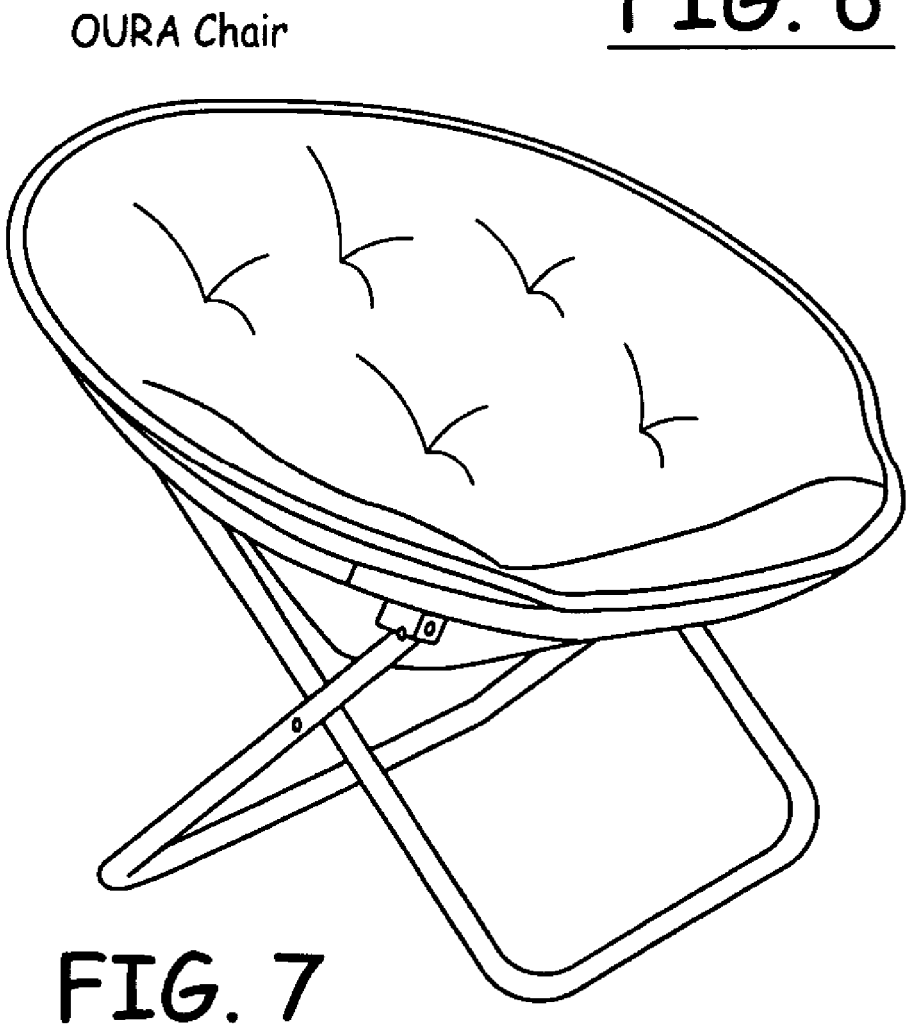
FIG. 7 is a perspective view of one embodiment of the lighting system of the present invention as used in a chair.

A cutaway profile view of a light module 12 in accordance with one aspect of the present invention is depicted in FIG. 2A. FIG. 2B shows a top view of a light module 12 in accordance with the present invention. The light module 12 has three lights or light sources 32 emitting different colors. According to one embodiment, each light 32 is a light emitting diode ("LED"). The three lights are red, green, and blue, respectively. Thus, a light module 12 may have four connections: one control line for each of the LEDs and one line for either power or ground. In an alternative aspect of the present invention, each module 12 may have more than three lights 32.

The module 12 has a cover component 34 that is positioned on a top portion 36 of the module 12. In one aspect of the invention, the cover component is a circular piece with a hole 36 in the center that is positioned above the lights 32 as shown in FIG. 2A so that the light from the lights 32 can pass through the hole 36. The cover component 34 is made of a soft material that provides protection to the lights 32 while allowing the pillow into which the system 10 is integrated to be used without the user detecting by physical touch the presence of the modules 12 in the pillow. In one embodiment, the cover component 34 is made of soft polyvinyl chloride ("PVC"). Alternatively, the cover component can be made of any known material.

Returning to FIG. 1, the cushioned material layers 20 are made of foam. Alternatively, the cushioned material layers 20 are made of any known soft or cushioned material. The modules 12 are sandwiched between the two cushioned material layers 20. A bottom portion 38 of each module 12 as shown in FIG. 2A is placed in contact with the bottom cushioned layer 20 and the top cushioned layer 20 is then placed on top of the bottom cushioned layer 20 and the modules 12. In one embodiment, each module 12 is glued or attached in some other known fashion to the bottom cushioned layer 20 and a hole 40 is formed in the top cushioned layer 20 for each module 12 such that when the top cushioned layer 20 is placed on top of the bottom cushioned layer 20 and the modules 12, each module 12 is positioned in one of the holes 40 of the top cushioned layer 20. While form may be used in some applications or systems, there are situations in which foam or cushioning is not required. For example, the present invention may be used to create a display in a hollow body with generally or substantially rigid sides (see, e.g., FIG. 3) or a hollow fixture such as a paper lantern (see, e.g., FIG. 6). It should be appreciated that the effect of a display in accordance with the present invention may be modified or enhanced by selecting a particular light transferring or diffusing material for one or more surfaces or component materials of the article containing a light module 12. Similarly, the article could use a reflective component to direct or modify the illumination of the display.

The power source 16 is a battery power source. The power source 16 requires three "AA" batteries. Alternatively, the power source 16 may comprise any number of any type of battery. In further alternatives, the power source is a wall outlet, an AC transformer, a car lighter, any other power source or combination thereof.

The wires 14 and 24 are typical electrical wires used for battery powered items. Alternatively, the wires 14, 24 can be any suitable electrical wires appropriate for an electrically-powered item. In some embodiments, all or a portion of the system 10 may incorporate suitable wireless technology. For example, a suitable wireless remote may be used to turn the system 10 on or off or to select a particular mode of operation.

The activation switch 22 sends a command to the IC control unit, e.g., on, off, or is a switch that simply completes the circuit (i.e., in some embodiments, it may not communicate with the IC controller). The slide activation switch 26 is a mode switch. It sets the device, apparatus or system to a predetermined operational mode, such as on, off, "try-me," etc. The apparatus 10 can include any other known activation component such as, for example, a shake sensor, remote switching assembly, a thermal sensor, a light sensor, or a sound sensor.

The CPU 18 is an integrated circuit that controls the operation of the lights 32 in each of the modules 12. That is, the integrated circuit controls which lights 32 are activated at any given time and the duration of that activation. It is the integrated circuit that controls any lighting pattern of the apparatus 10 as described above. While an integrated circuit is depicted, it should be appreciated that any suitable controller or control unit may be used to control the functions, appearance and operations of the present invention.

Figure 9A:
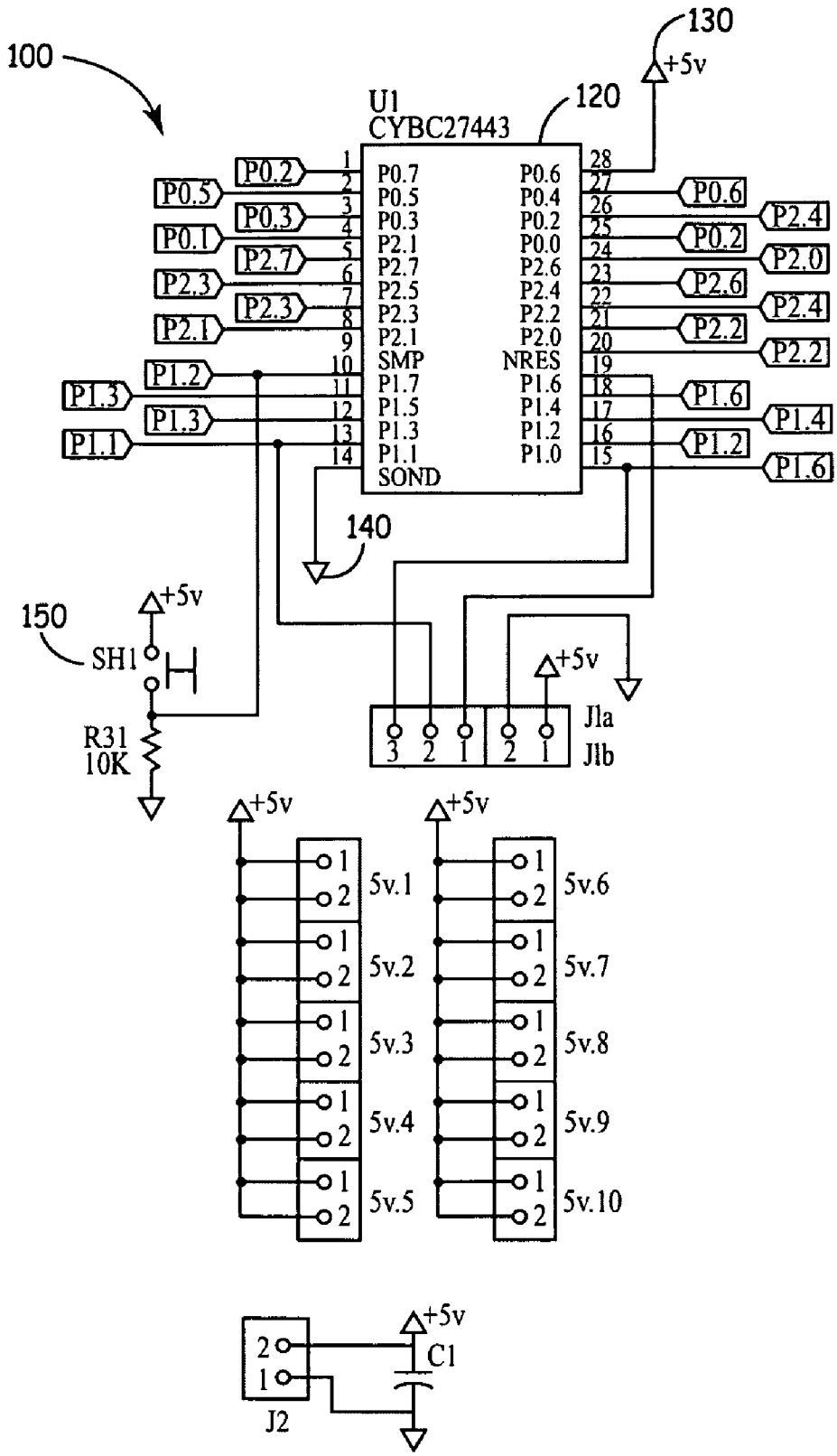
FIG. 9A is a schematic diagram of an exemplary lighting system of the present invention.
Figure 9B:
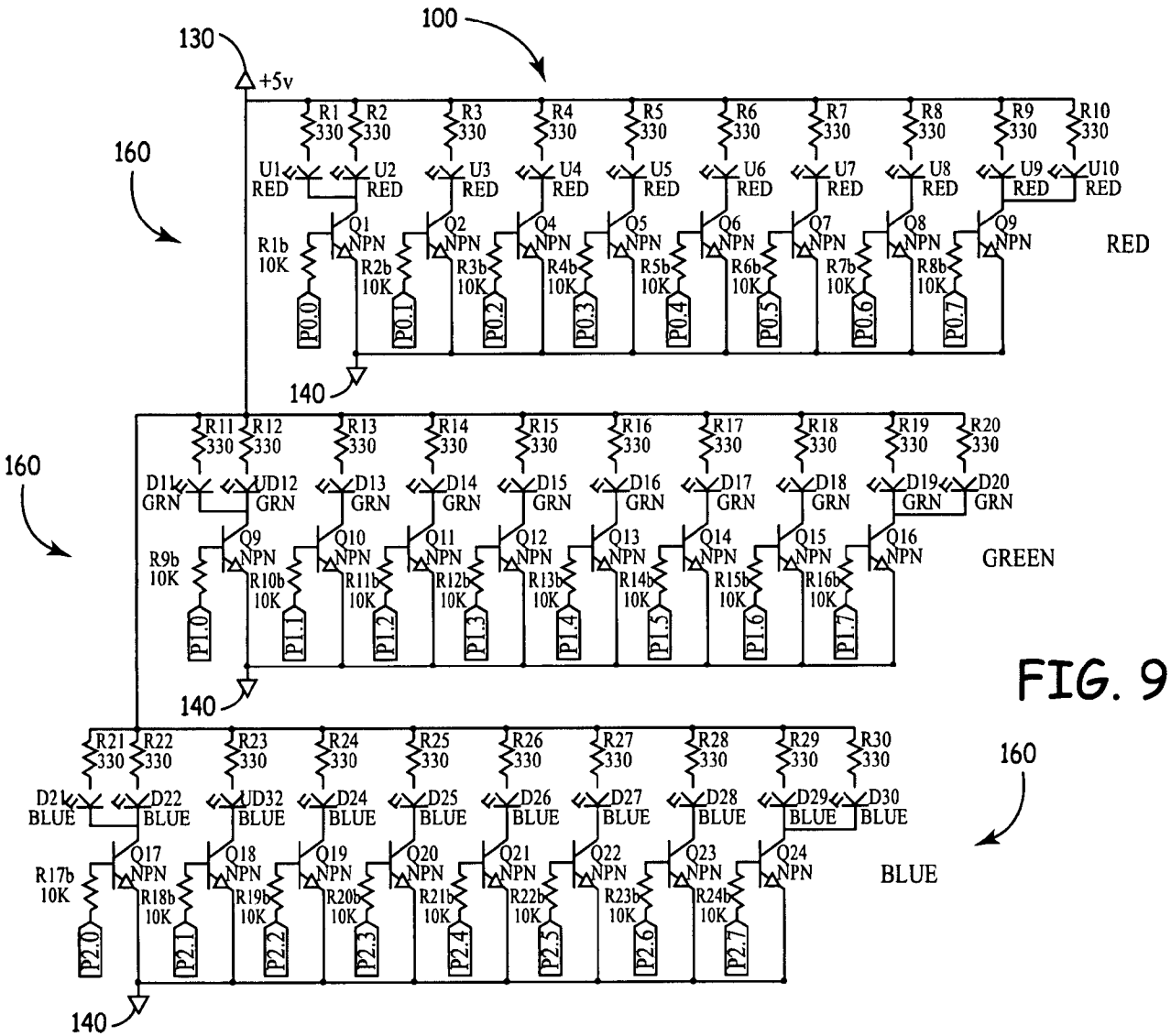
FIG. 9B is a schematic diagram of LED arrays of an exemplary lighting system of the present invention.

FIGS. 9A and 9B are schematic diagrams of an exemplary lighting system 100 in accordance with an embodiment of the present invention. The lighting system includes a microcontroller 120, or other appropriate integrated circuit, that controls LED arrays 160. Pin 28 of microcontroller 120 is in electrical connection with a voltage supply 130 (not shown), pin 14 of microcontroller is in electrical connection with ground connection 140, and microcontroller 120 is in electrical connection with switch 150, which is configurable by a user to open and close the circuit as desired. Appendix A of this application illustrates exemplary RAM requirements for a microcontroller used in one embodiment of the present invention.

With reference to FIG. 9B, LED arrays 160, which are controlled by microcontroller 120, include ten red LEDs D1-D10, ten green LEDs D11-D20, and ten blue LEDs D21-D30. Each LED array 160 is connected in parallel to voltage supply 130 and ground connection 140 as seen in FIG. 9B. Between the voltage supply 130 and the LEDs are 330 Ohm resistors R1-R10 for LEDs D1-D10 respectively, resistors R1-R20 for LEDs D11-D20 respectively, and resistors R21-R30 for LEDs D21-D30 respectively. Each array also includes a plurality of transistors, configured as seen in FIG. 9B, including transistors Q1-Q8 connected with the red LEDs' collectors, transistors Q9-Q16 connected with the green LEDs' collectors, and Q17-Q24 connected with the blue LEDs' collectors as shown in FIG. 9B. Each transistor's emitter is connected to ground 140, and each transistor's base is connected to the microcontroller's connecting pins, with a 10 kOhm resistor therebetween (resistors R1*b*-R8*b* for transistors Q1-Q8 respectively, resistors R9*b*-R16*b* for transistors Q9-Q16 respectively, and resistors R17*b*-R24*b* for transistors Q17-Q24 respectively). As seen in FIGS. 9A and 9B, microcontroller's 120 pins 1-4 and 24-27 are in electrical connection with resistors R1*b*-R8*b* for controlling the red array, microcontroller's 120 pins 10-13 and 15-18 are in electrical connection with resistors R9*b*-R16*b* for controlling the green array, and microcontroller's 120 pins 5-8 and 20-23 are in electrical connection with resistors R17*b*-R24*b* for controlling the blue array.

In this configuration of exemplary lighting system 100, the transistors, the operation of which is well known in the art, function as switches that allow microcontroller 120 to control each LED in the array 160 individually. The physical LEDs D1-D10 (red), D11-D20 (green), and D21-D30 (blue) respectively, are situated in close proximity, such that microcontroller 120 can create any desired color, at a desired time, and for a desired duration, by managing the intensity of the current across each transistor in a light module (e.g., light module [D1, D11, D21], light module [D2, D12, D22], light module [D3, D13, D23], etc.). Lighting system 100 is configurable in products similarly as lighting system 10. Whereas lighting system 10 includes a light module 12 embedded in a pillow and is controlled by CPU 18, similarly, lighting system 100 includes a plurality of light modules formed from LEDs D1-D10, D11-D20, and D21-D30, that are controlled by microcontroller 120.

In one embodiment, the LEDs are driven at either full on or full off. The amount of light emitted by an LED is controlled by varying the amount of time that the LED is switched on over the course of a fixed period of time, commonly referred to as "pulse width modulation." In this embodiment, it is critical that the pulse width modulation period is short enough so that the LED switches between on and off faster than the human eye can detect. For example, a period of 50 μS should be more than sufficient to be imperceptible to the human eye.

In one embodiment of the present invention, the light modules 12 are organized in groups of eight. For simplification of control logic, LEDs of the same color from each of the eight light modules 12 may be connected together at a single I/O port of the microcontroller. Thus, in this embodiment, the circuit uses three ports of eight control lines each, for a total of twenty-four control lines, to individually control any of the three LEDs within any of eight individual modules 12. This level of control makes it possible to generate any color of the visible spectrum.

In a further embodiment, a ramp pattern may be used to produce different colors from one or more light modules. One method of applying a ramp pattern initializes all of the one or more light modules 12 to the same points of the ramp pattern. Over time, the individual red, green and blue LEDs will ramp up and down, in unison, producing single, but changing, colors. Adding light modules 12 will increase the intensity of the light or will allow coverage of a greater area, but will not increase the number of colors visible at any single point in time.

Figure 10:
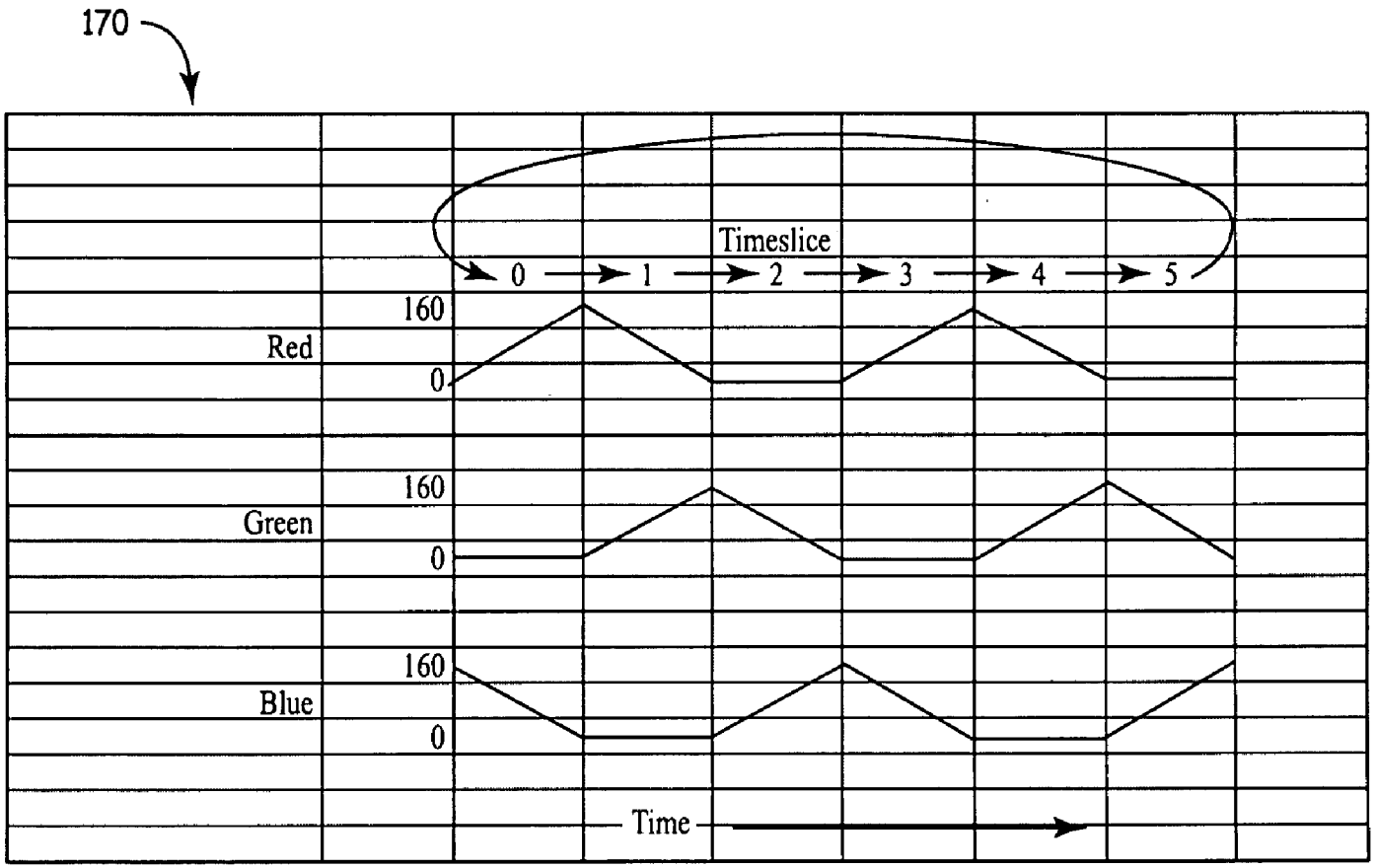
FIG. 10 is a diagram of a simple ramp pattern that may be used in accordance with the present invention.

A second exemplary method of using a ramp pattern 170, as illustrated in FIG. 10, applies to systems using two or more light modules 12. With this method, the two or more light modules 12 are initialized to different points on the ramp pattern. Even though the light modules 12 follow the same pattern, the color produced by one module will be specifically and intentionally different from other modules in the same system. For example, in a two module system, initializing a first light module 12 to the values at the beginning of Timeslice 0 of ramp pattern 170 produces the color blue since the values for the red and green LEDs are zero at this point on the curve. Initializing a second light module 12 to the values at the beginning of Timeslice 1 of ramp pattern 170 produces the color red since the values for the blue and green LEDs are zero at this point on the curve. At startup, the first light module 12 will begin changing from the color blue to the color purple and eventually to the color red while the second light module 12 changes from the color red to the color yellow and eventually to the color green. This method will allow any number of colors to be produced simultaneously, limited only by the number of individual light modules.

Figure 11:
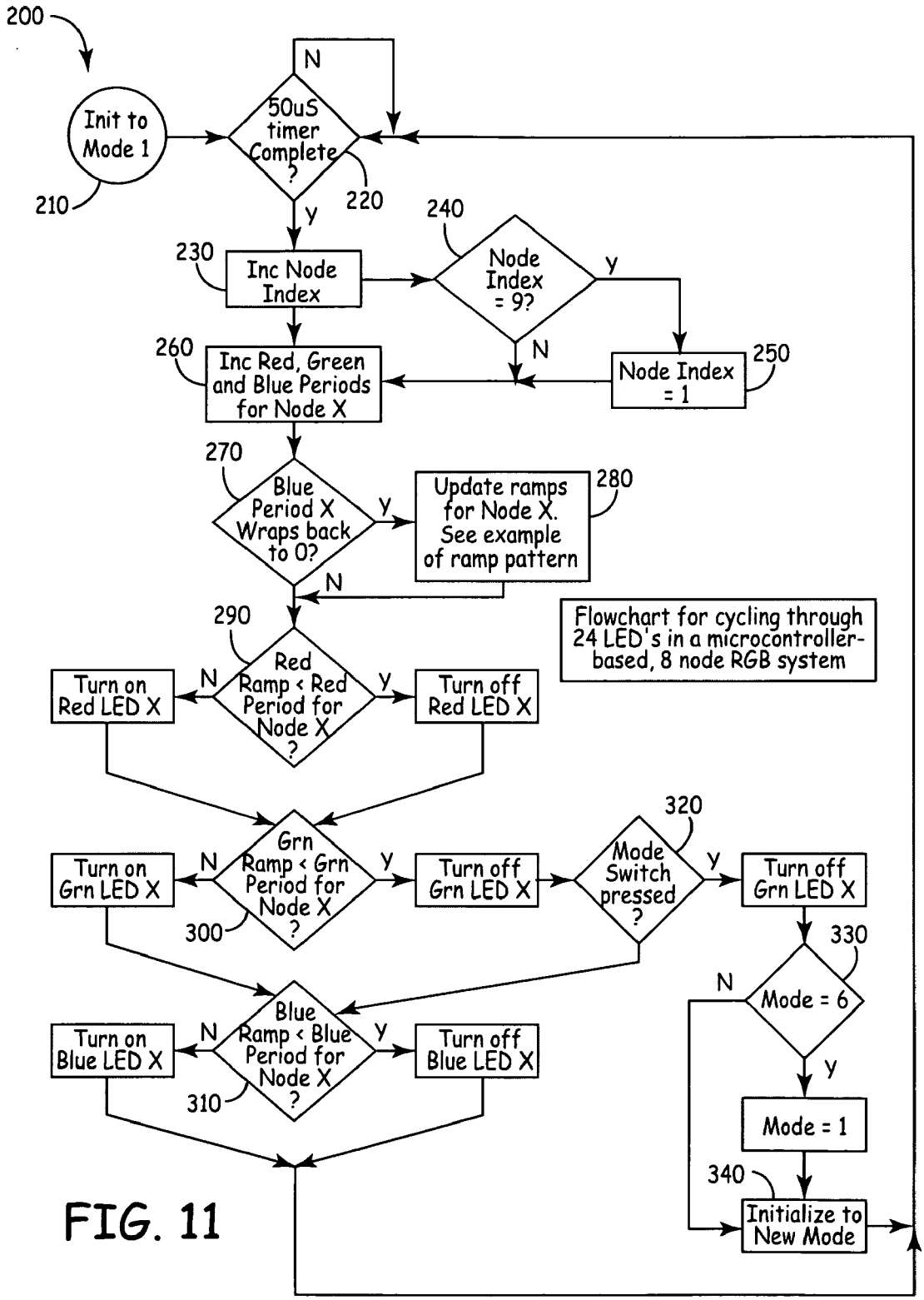
FIG. 11 is a flow chart of an exemplary embodiment of a method of cycling through the LEDs of the present invention.
Figure 12:
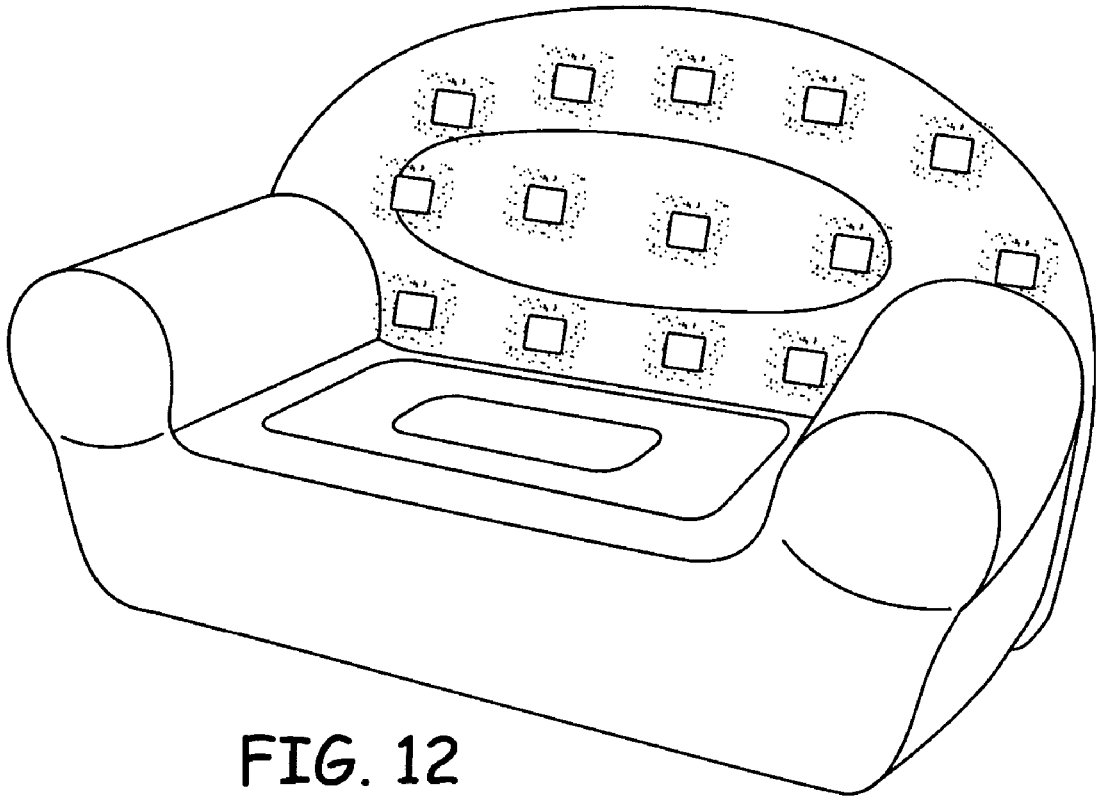
FIG. 12 is a perspective view of one embodiment of the lighting system of the present invention as used in an inflatable lounge chair.
Figure 13:
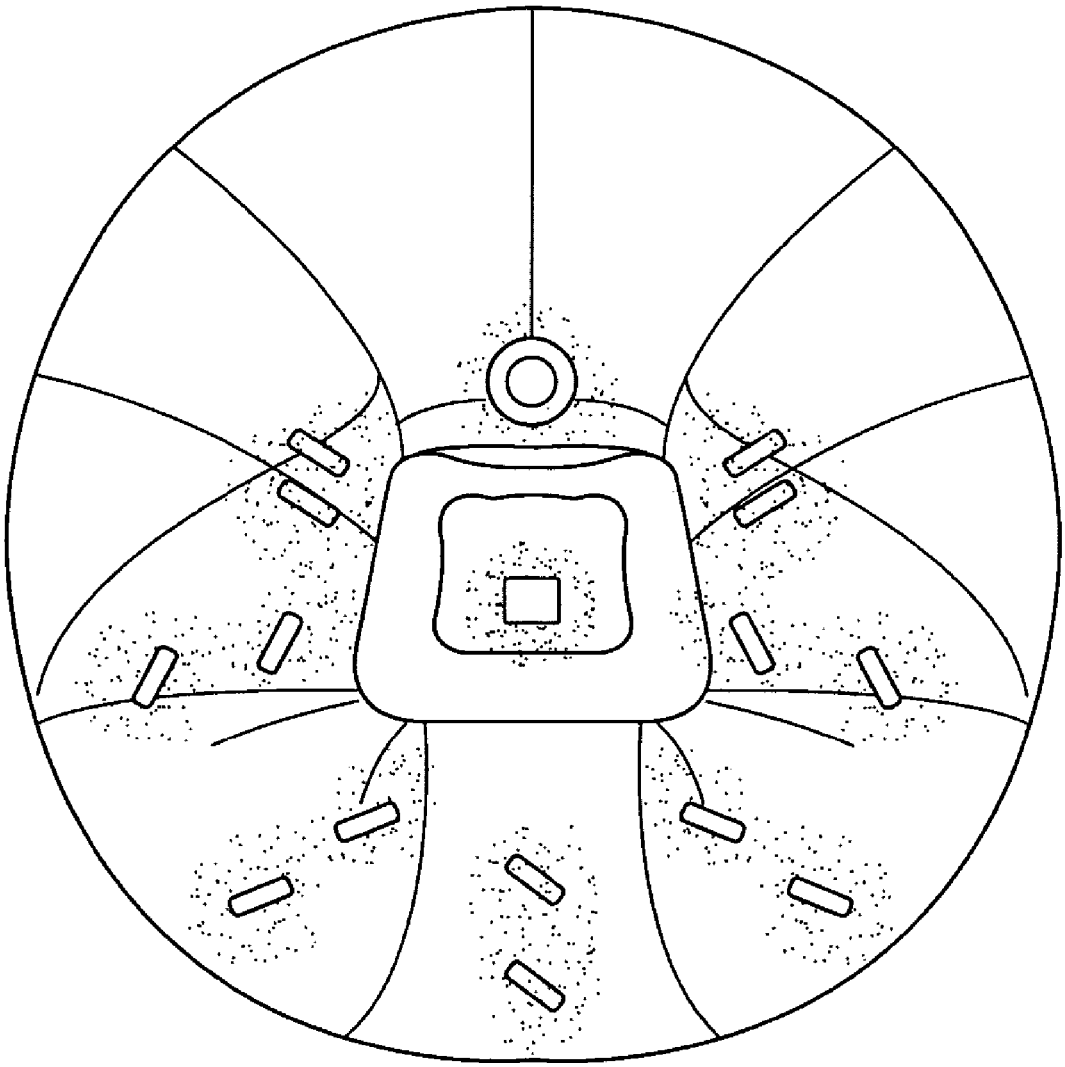
FIG. 13 is a perspective view of one embodiment of the lighting system of the present invention as used in an inflatable beanbag style chair.

FIG. 11 is a flow chart 200 of an exemplary embodiment of a method of cycling through all the LEDs in accordance with the present invention. At step 210, the system finishes initialization of the lighting system and moves to the first step of the cycle 220. Two sets of example initialization code are given in Appendix B of this application. One set of initialization code illustrates initial values for a "standard show." That is, a cycle during which all the light modules change in unison. The second set of initialization code illustrates initial values for a "rainbow show." That is, a cycle during which a rainbow wipe of colors is displayed. Typically, several "shows" or modes will be available to select from.

Once at step 220, the pulse width modulation period timer is checked. Once the timer has reached the end of the designated time period, the node index, indicating one of the eight light modules 12 in this example, is incremented [step 230]. If the node index reaches the value nine, or in other cases, a value that indicates that the value of the node index has gone beyond the number of light modules 12 in the system, the node index is reset to the value one [steps 240 and 250]. After incrementing the node index, the periods for each of the red, green and blue LEDs of the light module indicated by the node index are incremented [step 260].

In steps 270 and 280, it is determined whether the period for the blue LED should be reset back to zero. If that is the case, then the values for the LEDs of the light module indicated by the node index are updated to the initial values of a specified ramp pattern. That is, once a fixed time period has passed, the display pattern is reset to the initial values.

During steps 290, 300 and 310, it is determined, for each of the three LEDs (red, green and blue), whether the ramp value is less than the period value. Generally, it is determined whether the LED should be switched on or off. After these steps are completed, the pulse width modulation period timer is checked in step 220, and the process just discussed is repeated.

In a further embodiment, it may be possible to change the display pattern of the light modules 12. In such an embodiment, the mode switch is checked at step 320 to determine if a change has been made. If the mode switch was changed, the mode value is incremented or reset to one if the value incremented to is beyond the number of modes available [step 330]. The light modules are then set to the initialization values of the new mode selected [step 340] before repeating the process.

In one embodiment, the apparatus 10 of the present invention is integrated into a pillow, as shown in FIG. 8, such that soft pillow material such as, for example, polyfill or other suitable material, surrounds the apparatus 10 in the pillow.

In other embodiments, the lighting system of the present invention may be used on or in furniture items to create a stimulating visual effect. For example, the lighting system may be used in inflatable furniture, such as shown in the lounge chair in FIG. 12 and the beanbag style chair in FIG. 13. Further examples include children's inflatable toys, inflatable pool toys and floating devices. The inflatable furniture is typically manufactured from PVC, Nitrile PVC ("NPVC") or vinyl. Alternatively, any suitable material may be used.

Figure 14:
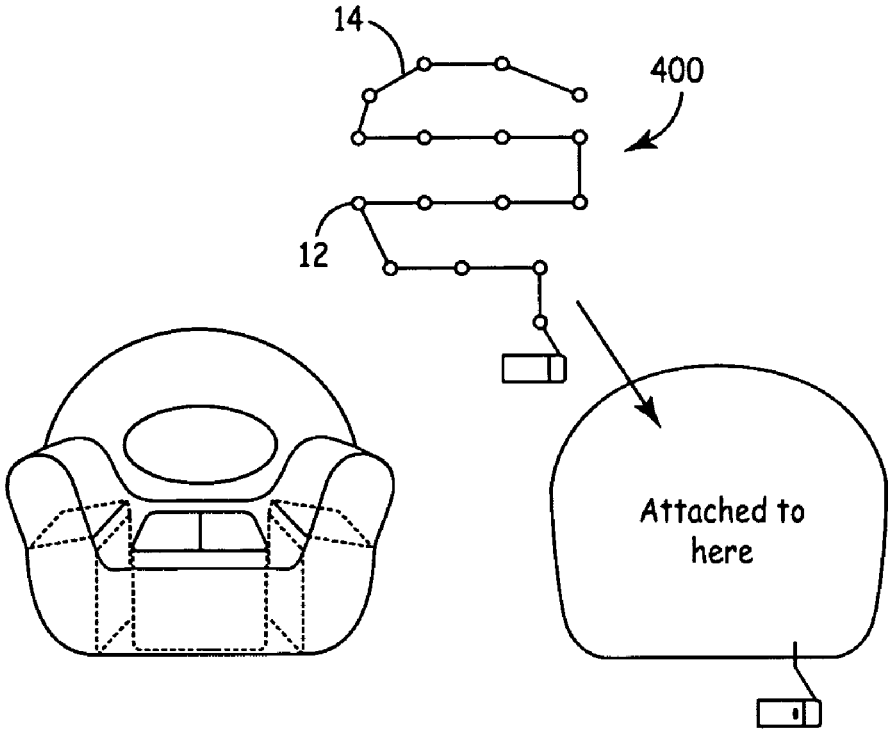
FIG. 14 is a schematic diagram of one means of attaching the lighting system of the present invention to furniture items.
Figure 14:
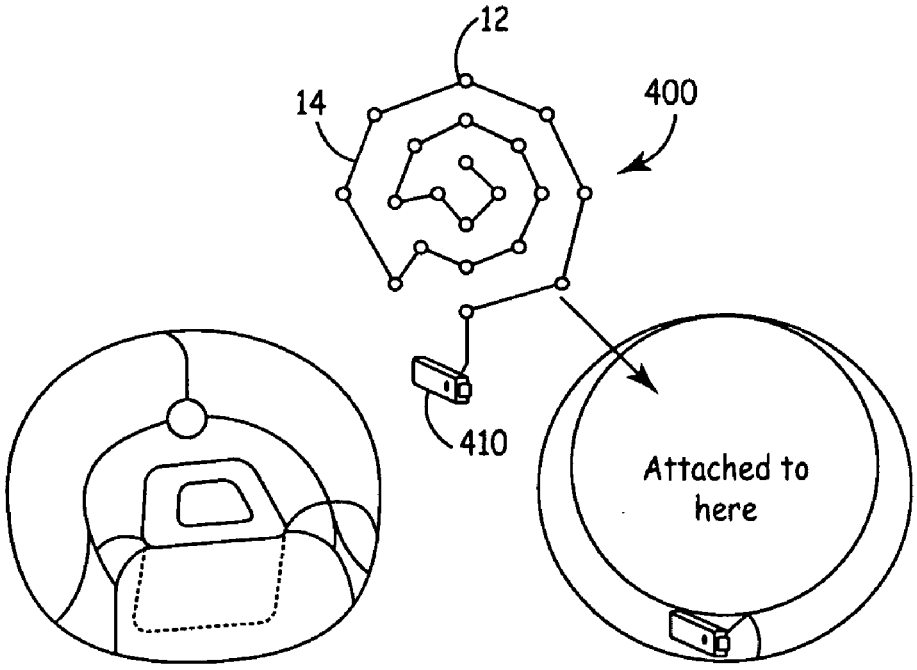
Figure 15:
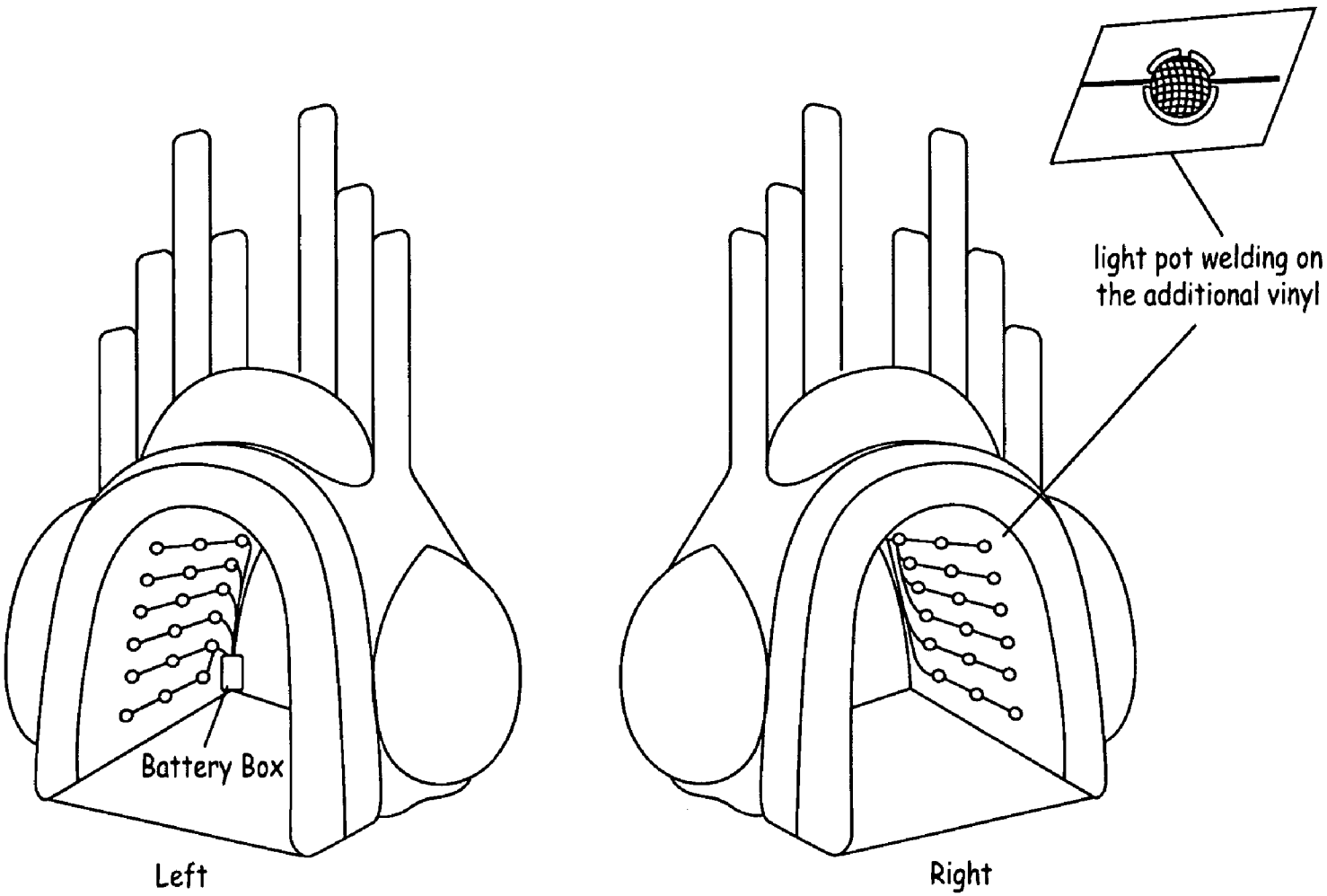
FIG. 15 is a schematic diagram of an alternative means of attaching the lighting system of the present invention to furniture items.
Figure 16:
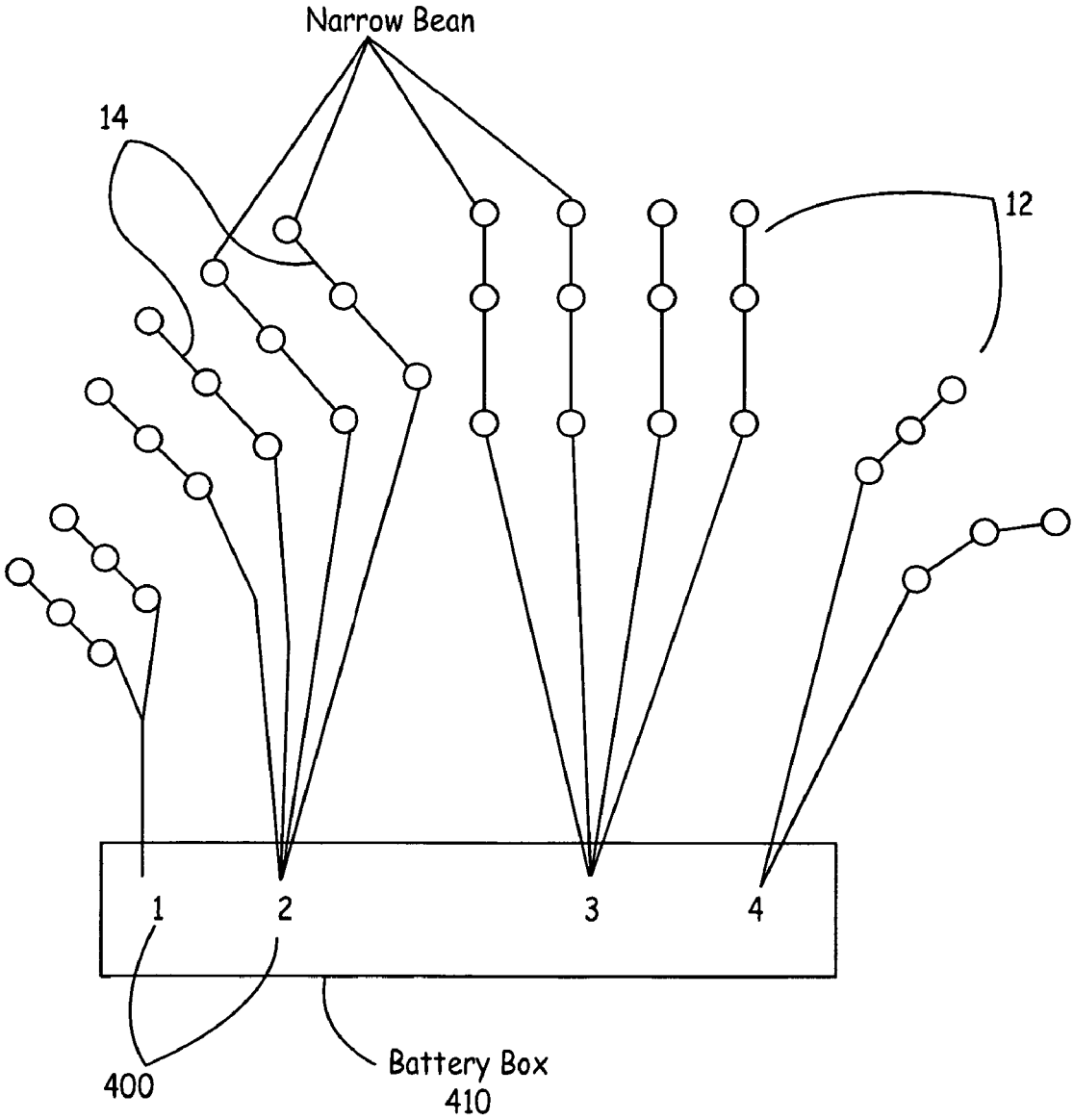
FIG. 16 is a schematic diagram of one embodiment of the present invention having multiple strings, or webs, of light modules.

The lighting system, including the wires 14 and lighting modules 12, may be attached to the furniture as shown in FIG. 14. Typically, the lighting system will consist of a preset string 400, or web, of lighting modules 12. As illustrated in FIG. 16, there may be multiple preset strings 400, or webs, of lighting modules 12 extending from the battery pack 410 and throughout the article of furniture. The lighting system, in one embodiment, may be integrated into the article of furniture by heat sealing the system beneath an overlying layer of PVC, NPVC, vinyl or other suitable material. Alternatively, other means of attachment may be used, such as gluing or welding the light modules to the article, as illustrated in FIG. 15.

Figure 17:
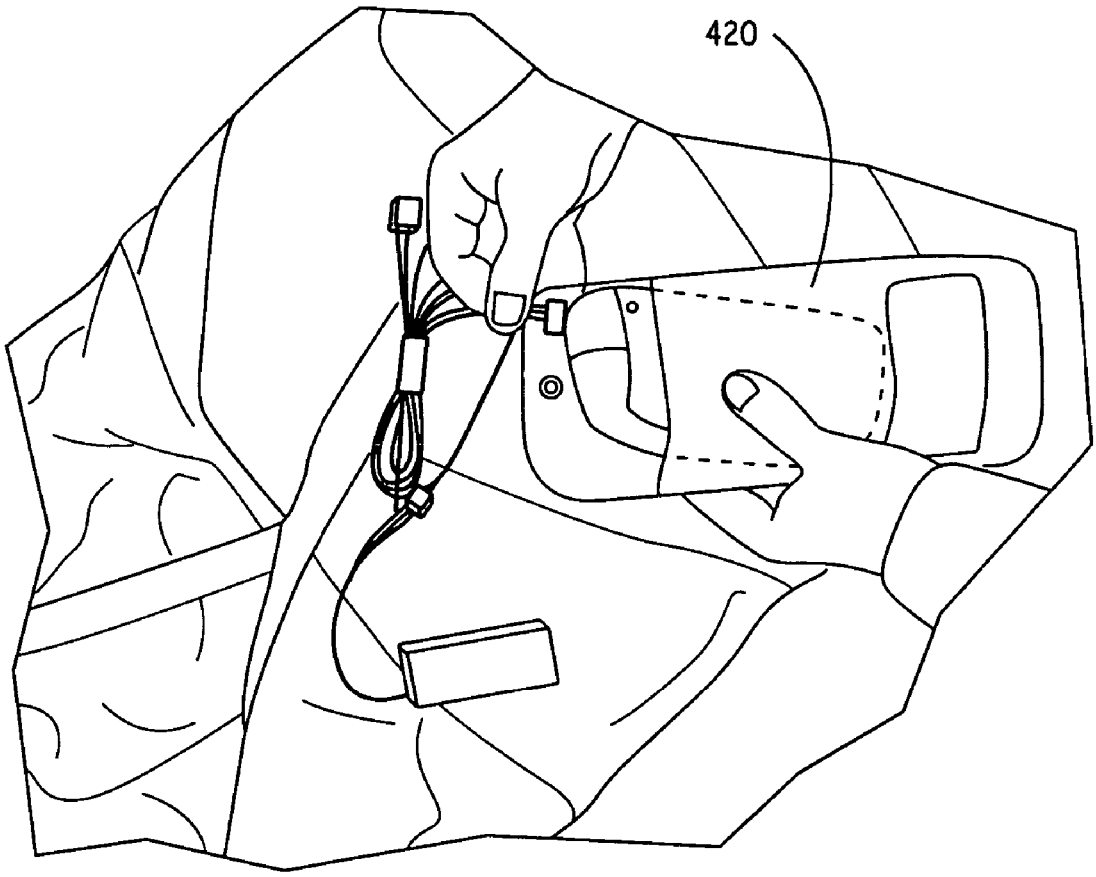
FIG. 17 is a perspective view of one embodiment of a storage compartment for the microcontroller and battery pack of the present invention that is attached to an article of furniture.

The battery pack 410 and microcontroller, in an exemplary embodiment, may be attached to the article of furniture by means of its own storage compartment 420, illustrated in FIG. 17. The storage compartment 420 may be made out of any suitable material, such as PVC, NPVC or vinyl, and may be attached to the article of furniture using any suitable attachment means, such as heat sealing, gluing, snapping, buttoning or any other means of fastening. Typically, the storage compartment 420 will be accessible by the user. Alternatively, the storage compartment 420 may be in a location that is not accessible, such as in one-time use items or disposable items.

The lighting system of the present invention may further be used in other items. For example, the lighting system may be used on or in articles of clothing, such as shirts, hats, jackets, etc. Similarly, the lighting system may be used in book bags, purses, briefcases, etc. Additionally, the lighting system may be used in toys, such as stuffed animals or balls and blocks of all shapes and types of material. The lighting system may be attached to such items by sewing the system into the material or gluing the system onto the material. Alternatively, any suitable means of attachment may be used to generally integrate or embed the lighting system to the fabric or item, including means of attachment previously mentioned.

Although the present invention has been described with reference to preferred embodiments, persons skilled in the art will recognize that changes may be made in form and detail without departing from the spirit and scope of the invention.

We claim:

1. A selectively illuminable plush toy having a body with an exterior surface, the toy comprising:

(a) an electrically conductive web internal to and integrated with the plush toy, the web comprising a plurality of individual light modules and one or more strings, each string comprising at least one of the plurality of light modules, each light module comprising a portion carrying a plurality of LED lights such that light emitted from the plurality of LED lights of an individual light module blends to form one or more colors, (b) a power source electrically coupled to the web;

(c) an integrated circuit operably coupled to the web, the integrated circuit operating the plurality of light modules such that the blended light emitted by the plurality of LED lights of each light module changes in a selected pattern; and (d) a soft material surrounding the plurality of light modules, the power source, and the integrated circuit, wherein the soft material is selected to be light transferring or diffusing, and the plurality of light modules are distributed in the plush toy, such that the exterior surface of the body is lighted by the blended light emitted by the plurality of LED lights.

2. The plush toy of claim 1, wherein the integrated circuit is configured to individually ramp up and down the intensity of the light of the plurality of LED lights.

3. The plush toy of claim 1, wherein at least two of the plurality of LED lights of the a light module are a different color from each other.

4. The plush toy of claim 3, wherein the colors of the LED lights include at least two of red, blue, and green.

5. The plush toy of claim 4, wherein the plurality of light modules each comprise three LED lights, and further wherein one of the LED lights is red, one is green, and one is blue.

6. The plush toy of claim 1, further comprising a mode switch configured to set the plurality of light modules to one of at least three predetermined operational modes.

7. The plush toy of claim 1, wherein the plurality of light modules each further comprise a cover component comprising a pliable material and an area permitting the passage of light.

8. The plush toy of claim 7, wherein the cover component of each of the plurality of light modules comprises soft polyvinyl chloride ("PVC").

* * * * *